US008789251B2

(12) United States Patent
Labow

(10) Patent No.: US 8,789,251 B2
(45) Date of Patent: Jul. 29, 2014

(54) METHOD AND APPARATUS FOR EMBEDDING ORNAMENTAL OBJECTS INTO SHEET MATERIAL

(76) Inventor: Edward D. Labow, Stockton, NJ (US)

( * ) Notice: Subject to any disclaimer, the term of this patent is extended or adjusted under 35 U.S.C. 154(b) by 101 days.

(21) Appl. No.: 13/233,783

(22) Filed: Sep. 15, 2011

(65) Prior Publication Data

US 2012/0067084 A1 Mar. 22, 2012

Related U.S. Application Data

(60) Provisional application No. 61/383,463, filed on Sep. 16, 2010.

(51) Int. Cl.
*B23P 5/00* (2006.01)
*A44C 17/04* (2006.01)
*A44C 17/02* (2006.01)

(52) U.S. Cl.
CPC ..... *A44C 17/02* (2013.01); *A44C 17/04* (2013.01)
USPC ..... 29/10; 29/896.4; 29/896.41; 29/896.43; 29/798; 63/26; 63/27

(58) Field of Classification Search
USPC ..... 29/10, 896.4, 896.43, 896.41, 798; 63/26, 27; 72/234, 324; 227/144; 26/12, 16, 15 R
See application file for complete search history.

(56) References Cited

U.S. PATENT DOCUMENTS 816,997 A * 4/1906 Pollard ..... 63/26
2,070,737 A * 2/1937 Kahan ..... 227/5
2,631,281 A * 3/1953 Hardy et al. ..... 227/39
2,667,686 A * 2/1954 Richardson ..... 29/10
2,944,260 A * 7/1960 Effgen ..... 221/164
3,261,072 A * 7/1966 Stanley ..... 29/10
3,339,481 A * 9/1967 Lang ..... 100/214
3,483,603 A * 12/1969 Briskin ..... 29/10
3,538,556 A * 11/1970 Shein ..... 24/114.11
3,839,770 A * 10/1974 Favre ..... 29/10
3,905,848 A * 9/1975 Williams ..... 156/63
3,911,722 A * 10/1975 Levine et al. ..... 72/479
3,960,307 A * 6/1976 Doyel ..... 227/144
3,977,581 A * 8/1976 Franzson ..... 223/44
3,995,365 A * 12/1976 Repplinger ..... 29/882
4,014,088 A * 3/1977 Oshier ..... 29/407.09
4,052,863 A * 10/1977 Poll ..... 63/28
4,077,284 A * 3/1978 Twichell ..... 81/7
4,079,617 A * 3/1978 Whiting ..... 72/404
4,323,611 A * 4/1982 Poll ..... 428/67
4,329,890 A * 5/1982 Ferstenberg ..... 81/7
4,356,627 A * 11/1982 Hoffman ..... 29/849
4,364,472 A * 12/1982 Waldmeier ..... 206/459.5
4,443,919 A * 4/1984 Guida et al. ..... 29/10
4,517,817 A * 5/1985 Levin ..... 63/26

(Continued)

*Primary Examiner* — David Bryant
*Assistant Examiner* — Bayan Salone
(74) *Attorney, Agent, or Firm* — McKee, Voorhees & Sease, P.L.C.

(57) ABSTRACT

A method and apparatus is provided for mounting deep-profile gemstones and crystals to a sheet of material. The method and apparatus may set a single stone or multiple stones simultaneously, either manually or in an automated process. A slit is formed in the material to receive the stone. A setting is positioned on the back side of the material with prongs extending through holes in the material, with the prongs being bent into engagement with the stone to retain the stone in the material, without the use of adhesives or thread.

17 Claims, 3 Drawing Sheets

(56) References Cited

U.S. PATENT DOCUMENTS

| | | | | | |
|---|---|---|---|---|---|
| 4,648,248 | A | * | 3/1987 | Raymond | 63/28 |
| 4,742,704 | A | * | 5/1988 | Wellington et al. | 72/57 |
| 4,750,245 | A | * | 6/1988 | Moussouris | 29/10 |
| 4,998,430 | A | * | 3/1991 | Howe | 72/335 |
| 5,099,660 | A | * | 3/1992 | Dostourian | 63/28 |
| 5,123,265 | A | * | 6/1992 | Ramot | 63/28 |
| 5,188,679 | A | * | 2/1993 | Kretchmer | 148/538 |
| 5,232,752 | A | * | 8/1993 | Crespi et al. | 428/15 |
| 5,252,377 | A | * | 10/1993 | Poll | 428/137 |
| 5,271,132 | A | * | 12/1993 | Pepper et al. | 29/10 |
| 5,273,795 | A | * | 12/1993 | Ullrich | 428/15 |
| 5,315,739 | A | * | 5/1994 | Herman | 24/113 MP |
| 5,338,591 | A | * | 8/1994 | Poll | 428/67 |
| 5,400,304 | A | * | 3/1995 | Offenstein | 368/285 |
| 5,432,988 | A | * | 7/1995 | Woo | 29/10 |
| 5,475,910 | A | * | 12/1995 | Yamamoto | 29/10 |
| 5,526,668 | A | * | 6/1996 | Futamura et al. | 72/324 |
| 5,535,506 | A | * | 7/1996 | Chalfin | 29/798 |
| 5,611,144 | A | * | 3/1997 | Gusky | 29/896.411 |
| 5,628,114 | A | * | 5/1997 | Stern | 29/897.312 |
| 5,655,300 | A | * | 8/1997 | Gruppach | 29/896.411 |
| 5,761,780 | A | * | 6/1998 | Magi | 29/10 |
| 5,765,398 | A | * | 6/1998 | Bardisbanyan | 63/26 |
| 5,954,194 | A | * | 9/1999 | Simpson | 206/96 |
| 6,112,652 | A | * | 9/2000 | Wurmbach | 101/28 |
| 6,128,840 | A | * | 10/2000 | Boisvert | 40/124.191 |
| 6,253,432 | B1 | * | 7/2001 | Peters et al. | 29/10 |
| 6,413,618 | B1 | * | 7/2002 | Parker et al. | 428/195.1 |
| 6,465,101 | B1 | * | 10/2002 | MacGregor et al. | 428/412 |
| 6,472,039 | B1 | * | 10/2002 | Amen-Ra A | 428/42.1 |
| 6,474,236 | B1 | * | 11/2002 | Naniwa et al. | 101/477 |
| 6,491,424 | B1 | * | 12/2002 | Tardy | 368/283 |
| 6,637,829 | B1 | * | 10/2003 | Jenkins | 301/37.108 |
| D486,090 | S | | 2/2004 | Thomson | |
| 6,692,566 | B2 | * | 2/2004 | Kelly | 106/716 |
| 6,699,569 | B2 | * | 3/2004 | Lipper | 428/40.1 |
| 6,959,624 | B2 | * | 11/2005 | Knuston et al. | 81/7 |
| 7,025,496 | B2 | * | 4/2006 | Tardy | 368/278 |
| 7,056,070 | B2 | * | 6/2006 | Baklaian | 408/111 |
| 7,111,447 | B2 | * | 9/2006 | Rosenwasser | 59/35.1 |
| 7,267,463 | B2 | * | 9/2007 | Bayer et al. | 362/441 |
| 7,333,839 | B2 | * | 2/2008 | Hutchison et al. | 455/575.1 |
| 7,419,083 | B1 | * | 9/2008 | Cheng | 228/122.1 |
| 7,661,206 | B2 | * | 2/2010 | Osborn | 36/101 |
| 7,666,497 | B2 | * | 2/2010 | Takatsuki et al. | 428/337 |
| 8,286,315 | B2 | * | 10/2012 | Choi | 29/10 |
| 8,387,494 | B2 | * | 3/2013 | Murata et al. | 83/13 |
| 2002/0197435 | A1 | * | 12/2002 | Ra A | 428/42.1 |
| 2008/0235924 | A1 | * | 10/2008 | Waldner | 29/6.1 |
| 2008/0282510 | A1 | * | 11/2008 | Lee | 24/114.9 |
| 2010/0043193 | A1 | * | 2/2010 | Choi | 29/284 |

* cited by examiner

METHOD AND APPARATUS FOR EMBEDDING ORNAMENTAL OBJECTS INTO SHEET MATERIAL

CROSS-REFERENCE TO RELATED APPLICATIONS

This application claims priority under 35 U.S.C. §119 of a provisional application Ser. No. 61/383,463, filed Sep. 16, 2010, and which application is hereby incorporated by reference in its entirety.

FIELD OF THE INVENTION

This application is directed towards a method and apparatus for embedding ornamental or decorative objects into sheet materials. The objects may be stones or crystals, either faceted or non-faceted, natural or synthetic, of various sizes and shapes, as well as other pieces to be embedded in the material. For purposes of this application, all such objects will be referred to as "stones" or "crystals".

BACKGROUND OF THE INVENTION

Ornamental objects, such as stones, rhinestones, and crystals, are often used to decorate various products made of some type of material or fabric. For example, clothing, paper products such as greeting cards, artwork, cell phone covers, leather accessories, and the like may have stones or crystals mounted thereon to enhance the ornamental design.

There are three common methods for attaching such crystals to the material or fabric. First, the stone setting may be sewn or adhered to the material, with the stone retained in the setting on the top or outer surface of the material. Thread may not securely fasten the crystal, and thread breakage leads to loss of the crystal. Crystals may also be adhered to the outer surface of the material. However, adhesives may not provide a sufficient bond between the material and the crystal, particularly through repeated washing or cleaning of clothing. Crystals and stones may also be attached to the material using settings having prongs which extend through the material and are crimped over the crystal, which sits on the top or outer side of the material and the setting being on the back or inside of the material.

Typically, crystals used in the prior art are flat, low profile rhinestones which do not reflect, refract or disburse light as brilliantly as do full-sized, deep-profile crystals. Thus, such rhinestones are not as appealing or attractive as a full crystal, such as a stone.

Therefore, a primary objective of the present invention is the provision of a method and apparatus for embedding decorative objects, such as deep profile crystals or stones, firmly in a sheet of material, without the use of adhesives or thread.

Another objective of the present invention is the provision of a bejeweled product wherein a deep-profile stone is mounted through a slit in a sheet of material such that the stone resides on opposite sides of the material.

A further objective of the present invention is the provision of an assembly for mounting a stone into a sheet of material, including tools for cutting the material, positioning a setting for the stone, and positioning the stone in the setting.

Still another objective of the present invention is the provision of a method and apparatus for quickly and easily mounting stones on to material.

Yet another objective of the present invention is an automated method and apparatus for setting ornamental or decorative stones or crystals into a sheet of material.

A further objective of the present invention is the provision of a method and apparatus which can simultaneously mount a plurality of stones and crystals to a sheet of material.

Another objective of the present invention is the provision of a method and apparatus for mounting stones and crystals having different shapes and sizes to a sheet of material.

Yet another objective of the present invention is the provision of a method and apparatus for securely and durably mounting stones and crystals on to a sheet of material, and which are effective and efficient.

DETAILED DESCRIPTION OF THE INVENTION

In the present invention, stones or crystals 10 having a deep profile, such as a stone 10, are embedded into a sheet of material 12, such as fabric, paper, cardboard, leather, plastic, papyrus, wood veneer, composite, resin, metal, or other natural or synthetic material. It is understood that this list is not exclusive. Preferably, the material 12 is thinner than the depth of the stone and may be flexible.

Figure 4:
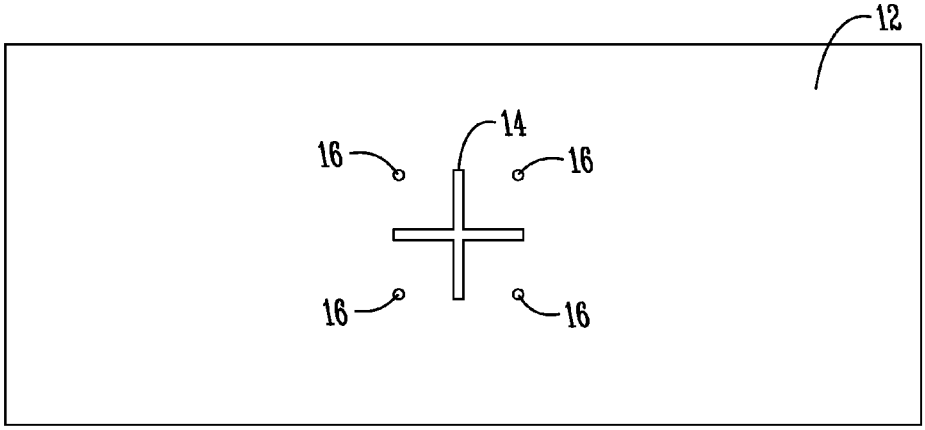
FIG. 4 is a top plan view of the material shown in FIGS. 1 and 2 into which the stone is to be embedded.

As shown in FIG. 4, the sheet of material 12 is cut, stamped and/or punched so as to have an X or crisscross incision 14 and a plurality of small holes 16. The number of holes 16 corresponds to the number of prongs 18 on a setting 20 used to secure the stone 10 to the sheet 12. It is understood that the shape of the incision 14 may be different from that shown in FIG. 4, as long as the stone 10 can extend through the sheet 12. Also, the number and location of prongs may vary, depending on the size and shape of the stone 10.

Figure 1:
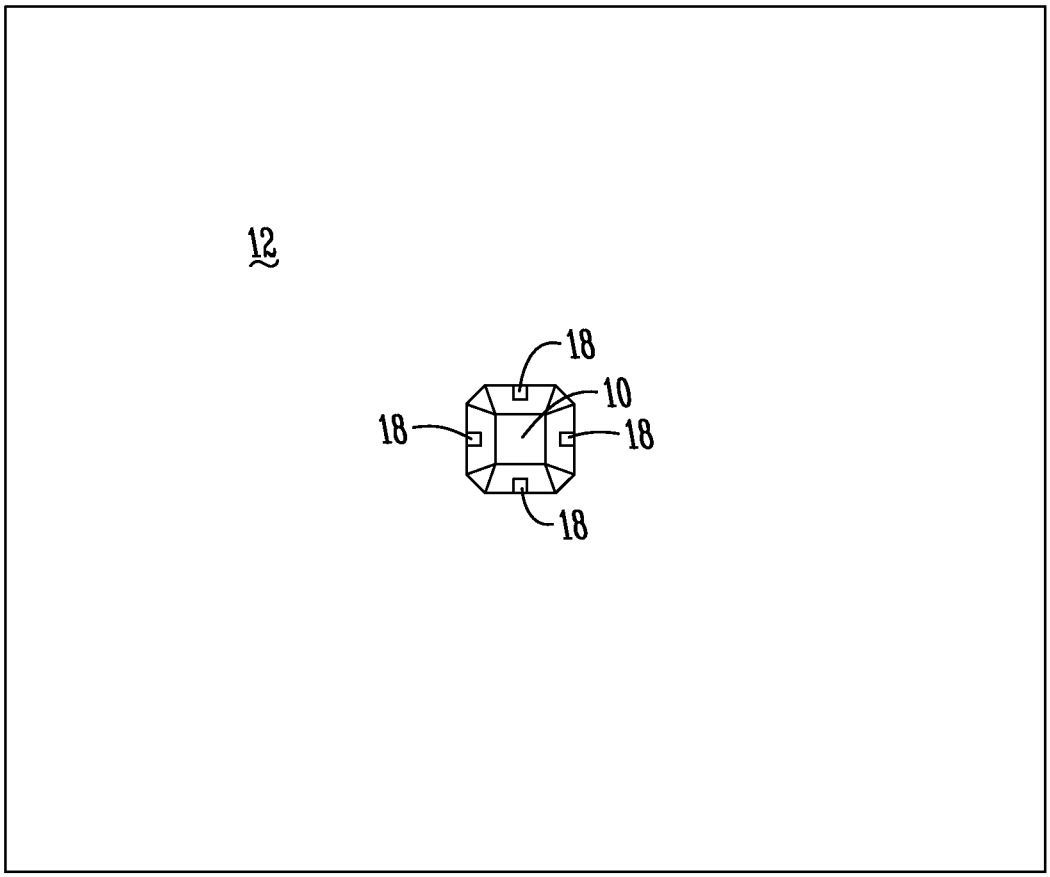
FIG. 1 is a top plan view showing a stone set into a piece of material according to the present invention.
Figure 2:
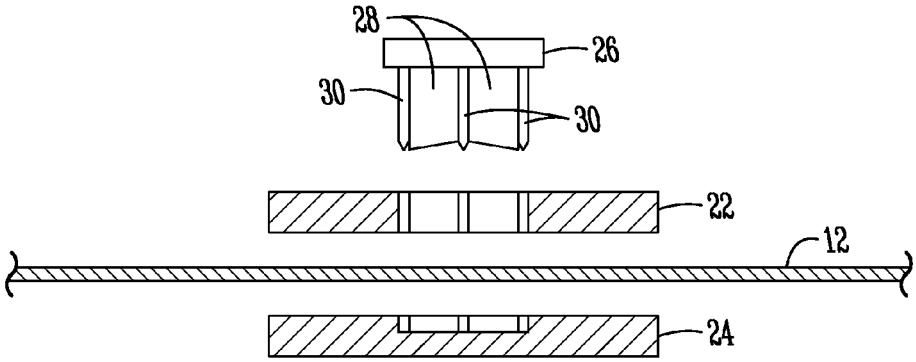
FIG. 2 is an exploded sectional view of an assembly for use in embedding stones into a thin material, such as paper, fabric, or plastic.
Figure 3:
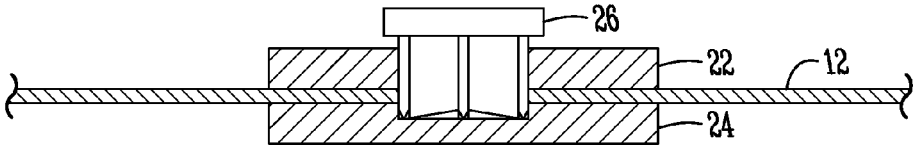
FIG. 3 is a sectional view of the components shown in FIG. 1 assembled to prepare the material for embedding of the stone.

The incision 14 and holes 16 may be formed manually or automatically using any convenient tool for cutting the material 12. FIGS. 2 and 3 show one embodiment of a tool for use in cutting the material 12. More particularly, the sheet of material 12 is sandwiched between a first plate 22 and a second plate 24. The plate 22 has slots and holes extending there through corresponding to the incision 14 and holes 16, for example, as shown in FIG. 4. The lower plate 24 has recesses corresponding to the incision 14 and holes 16. A cutting tool 26 has blades 28 in the pattern of the incision 14 and a set of awls or needles 30 corresponding to the holes 16. The tool 26 can be pushed through the first plate 22 and the sheet material 12 and into the second plate 24, either manually or as part of an automated machine. The plates 22, 24 ensure a clean cut in the material 12, without pulling or tearing the sheet. The tool 26 is then pulled out of the plates 22, 24, thereby leaving the incision 14 and holes 16 in the material 12, as seen in FIG. 4. The tool 26 may have a plurality of blades and sets of needles to simultaneously form multiple cuts in the material.

Figure 5:
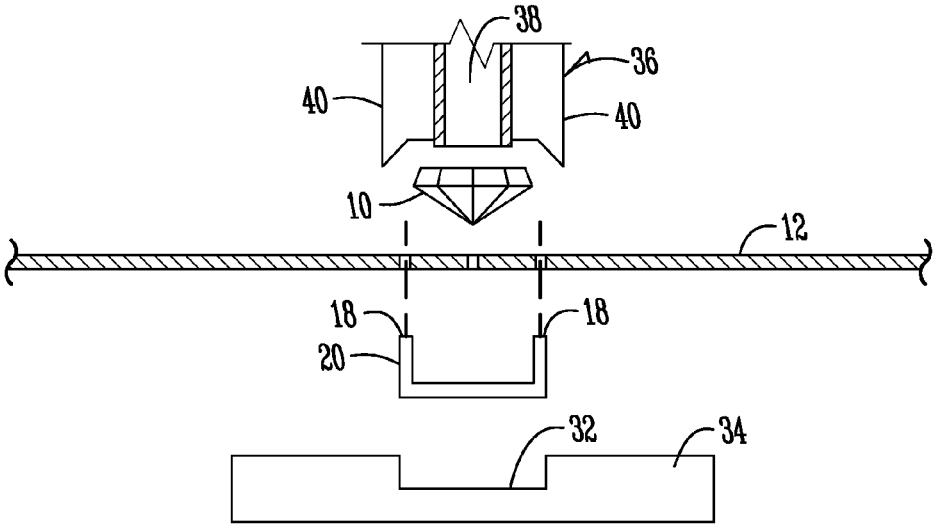
FIG. 5 is an exploded sectional view showing another assembly used to embed the stone into the material.
Figure 6:
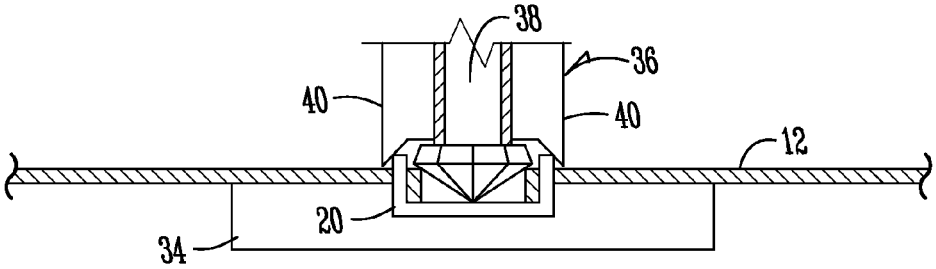
FIG. 6 is a view of the assembled components shown in FIG. 4.
Figure 7:
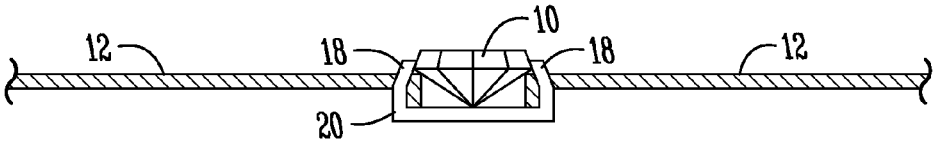
FIG. 7 is a sectional view of the finished product wherein the stone is mounted in the material using a setting with prongs.

FIGS. 5 and 6 show the next step in the process for embedding the stone 10 into the material 12. After the incision 14 and holes 16 are cut in the sheet 12, the setting 20 is positioned in a recess 32 of a base 34 which holds the setting 20 in position with the prongs 18 extending upwardly beyond the surface of the base 34. Then the material 12 is positioned over the base 34, with the prongs 18 extending through the aligned holes 16 in the material 12. The stone 10 is inserted downwardly through the incision 14 in the material 12 into the setting 20. As seen in FIGS. 6 and 7, a portion of the material 12 surrounding the incision 14 extends into the setting 20. The prongs 18 are then bent over the perimeter edge of the stone 10 to retain the stone in the setting 20 and in the material 12, as shown in FIG. 7.

The stone 10 can be positioned into the setting in any convenient manner, either manually or automatically. FIGS. 5 and 6 show one embodiment of a tool 36 for positioning the stone 10 into the setting 20. The tool includes a vacuum tube 38 connected to a vacuum source so as to hold the stone 10 against the end of the tube 38, and to apply pressure while the stone 10 is pressed into the sheet material 12. The tool 36 includes a plurality of arms having lower beveled ends 40 which crimp or bend the tips of the prongs 18 over the stone 10. When the vacuum is released, the tool 36 is lifted to release the stone. The tool 36 may have a plurality of recesses 32 and tubes 38 to simultaneously set multiple stones 10 into the material 12. It is understood that the stone may be retained on the tool 36 in other manners, without the use of a vacuum.

As seen in FIG. 7, the setting 20 is hidden behind the material 12, except for the small prongs 18 which extend through the material 12. The mounting method preserves the refractivity, reflectivity or light disbursement of the full crystals or stones 10 to enhance the ornamental appearance and design of the finished product. The upper surface of the crystal or stone is on the front side of the material and may be nearly flush with the outer or front surface of the material. The bottom surface of the stone resides within the setting 20 below the back side of the material. Thus, the stone preferably has a depth or thickness greater than the thickness of the material. The stone is physically secured to the material without the use of adhesives or thread, which can fail over time. Also, the full weight of the stone is distributed evenly over the material surface, via the setting, as opposed to having stress points as with the use of thread.

It is understood that the method can be automated using a machine which will embed various designs in a single stamping and which can embed multiple stones simultaneously. Alternatively, single stones can be mounted using the tools shown in the drawings or through manual work.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of mounting a stone onto a sheet of flexible material having opposite front and back sides, comprising:

forming a slit in the material;

position a setting on the back side of the material, the setting having prongs extending through the material, and the material adjacent the slit folding backwardly into the setting;

inserting a stone through the slit in the material and into the setting, with a rear portion of the stone within the setting being substantially uncovered from the folded material within the setting; and bending the prongs over the stone to retain the stone in the setting and on the material.

2. The method of claim 1 further comprising forming holes in the material adjacent the slit for receiving the prongs of the setting, and wherein the incision and holes are made simultaneously.

3. The method of claim 1 wherein the stone has a rear surface residing behind the material and a front surface substantially flush with the front side of the material.

4. The method of claim 1 wherein the stone inserted with a tool.

5. The method of claim 4 wherein the prongs are bent with the tool.

6. The method of claim 1 wherein the stone is inserted using a vacuum.

7. The method of claim 1 wherein the mounting of the stone is free from adhesives.

8. An assembly for mounting a stone in a flexible sheet of material having opposite front and back sides, comprising:

a first tool adapted to form a slit in the material;

a second tool adapted to position a setting behind the material with prongs of the setting extending forwardly through the material;

the second tool adapted to position the stone partially through the slit in the material and into the setting, whereby a front surface of the stone resides in front of the material and a rear surface of the stone resides behind the material; and the second tool adapted to bend the setting prongs over the stone to secure the stone to the material.

9. The assembly of claim 8 wherein the first tool includes a pair of plates to sandwich the material therebetween and a die to form the incision in the material.

10. The assembly of claim 8 wherein the first tool includes a die to simultaneously form the slit and holes in the material.

11. The assembly of claim 10 wherein the second tool includes a base to hold the setting.

12. The assembly of claim 8 wherein the second tool includes a vacuum to set the stone in the setting.

13. The assembly of claim 8 wherein the material adjacent the slit folds rearwardly away from the stone.

14. The assembly of claim 8 wherein the first tool forms holes in the material.

15. The assembly of claim 8 wherein the second tool positions a base of the setting at a spaced distance from the material.

16. The assembly of claim 8 wherein the second tool includes a base having an upper surface to support the material and a recess in the base to receive the setting.

17. The method of claim 1 wherein the insertion of the stone sandwiches the material adjacent the slit between the stone and the setting.

* * * * *